US008452211B2

(12) United States Patent
Maeda

(10) Patent No.: US 8,452,211 B2
(45) Date of Patent: May 28, 2013

(54) IMAGE FORMING APPARATUS

(71) Applicant: Canon Kabushiki Kaisha, Tokyo (JP)

(72) Inventor: Yoritsugu Maeda, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/688,042

(22) Filed: Nov. 28, 2012

(65) Prior Publication Data

US 2013/0084104 A1 Apr. 4, 2013

Related U.S. Application Data

(63) Continuation of application No. 12/843,633, filed on Jul. 26, 2010, now Pat. No. 8,351,824.

(30) Foreign Application Priority Data

Jul. 30, 2009 (JP) ..... 2009-178017

(51) Int. Cl.
*G03G 15/00* (2006.01)

(52) U.S. Cl.
USPC ..... 399/167; 399/36

(58) Field of Classification Search
USPC ..... 399/36, 167
See application file for complete search history.

(56) References Cited

U.S. PATENT DOCUMENTS

| | | | | |
|---|---|---|---|---|
| 5,412,302 | A * | 5/1995 | Kido et al. | 318/685 |
| 6,690,989 | B2 * | 2/2004 | Spindler et al. | 700/170 |
| 2002/0159791 | A1 * | 10/2002 | Chen et al. | 399/167 |
| 2006/0002745 | A1 * | 1/2006 | Iwasaki | 399/299 |

* cited by examiner

*Primary Examiner* — Ryan Walsh
(74) *Attorney, Agent, or Firm* — Canon USA Inc. IP Division

(57) ABSTRACT

A control unit sets a first feedback gain for suppressing an angular speed variation of a first frequency, which causes a misalignment of images to be overlaid with each other, to the first nd feedback unit in a first image forming mode in which images formed on the first and the second image carriers are overlaid, and sets a second feedback gain for suppressing an angular speed variation of a second frequency, which causes a periodic uneven density on an image that is to be formed with a uniform density, to the first feedback unit in a second image forming mode in which an image is formed using the first image carrier.

10 Claims, 12 Drawing Sheets

IMAGE FORMING APPARATUS

CROSS-REFERENCE TO RELATED APPLICATIONS

This application is a continuation of application Ser. No. 12/843,633, filed on Jul. 26, 2010, which claims the benefit of Japanese Patent Application No. 2009-178017 filed Jul. 30, 2009, which are hereby incorporated by reference herein in their entirety.

BACKGROUND OF THE INVENTION

1. Field of the Invention

The present invention relates to an image forming apparatus that drives an image carrier for forming a color image on a recording sheet, with a motor.

2. Description of the Related Art

There is an image forming apparatus in which a toner image is formed on a plurality of photosensitive drums used for performing a color image formation, the toner image is transferred onto an intermediate transfer belt, and then, the toner image is transferred onto a recording sheet from the intermediate transfer belt. The photosensitive drum is driven by a motor via a speed reduction gear, so that an angular speed variation or a peripheral speed variation of the photosensitive drum is generated. Therefore, there arises a color misregistration in which toner images of a plurality of colors, which are to be overlaid with each other, are not overlaid with each other during the color image formation, or a banding in which an image, which is to be formed with a uniform density, has a periodical uneven density. For example, the angular speed of the photosensitive drum varies over time as illustrated in FIG. 8A. FIG. 8B is a graph illustrating the variation component of the angular speed, which is obtained by performing Fourier transformation on the angular speed change, for each frequency. In FIG. 8B, peaks appear at about 3 Hz, about 36 Hz, and about 290 Hz. The variation in the relatively low frequency component at and near 3 Hz is an eccentric component of a gear 101, the variation at and near 36 Hz is an uneven rotation of a motor 100, and the variation at and near 290 Hz is a vibration generated when the gear 101 and the motor 100 mesh with each other. The variation in the angular speed at and near 3 Hz causes the color misregistration, and the variation in the angular speed at and near 36 Hz causes the banding.

There has been discussed a technique in which, to reduce the color misregistration, an angular speed of the photosensitive drum is detected to perform a feedback control of a motor, by which the angular speed variation of the frequency component caused by the speed reduction gear is reduced (Japanese Patent Application Laid-Open No. 6-175427).

However, it is difficult to achieve both the reduction in the color misregistration and the reduction in the banding from the reason described below. The angular speed variation illustrated in FIG. 8B can be suppressed by adjusting a feedback gain value, but the angular speed variation of all frequencies cannot be suppressed. According to a sensitivity function in the feedback control, when a variation of a certain frequency is intended to be attenuated, a variation of another frequency is amplified. For example, when a feedback gain, which suppresses the angular speed variation at and near 3 Hz that causes the color misregistration, is set, the angular speed variation at and near 36 Hz that causes the banding is amplified. Accordingly, when the feedback gain is adjusted to suppress the color misregistration, the banding becomes noticeable when a monochrome image is formed.

SUMMARY OF THE INVENTION

According to an aspect of the present invention, an image forming apparatus includes first and second image carriers that perform an image formation on a recording sheet, first and second motors that drive the first and second image carriers respectively to rotate, first and second detection units that detect an angular speed or a peripheral speed of each of the first and second image carriers respectively, first and second control units that perform a feedback control on the angular speeds of the first and second motors respectively according to the result of the detection by the first and the second detection units, and a control unit that sets a feedback gain of the control by the first and second feedback units, wherein the control unit sets a first feedback gain for suppressing an angular speed variation of a first frequency, which causes a misalignment of overlaid images, to the first and the second feedback units in a first image forming mode in which images formed on the first and the second image carriers are overlaid, and sets a second feedback gain for suppressing an angular speed variation of a second frequency, which causes a periodic uneven density on an image that is to be formed with a uniform density, to at least one of the first and second feedback units corresponding to the image carrier that performs the image formation, in a second image forming mode in which an image is formed using either one of the first and second image carriers.

According to another aspect of the present invention, an image forming apparatus includes a plurality of image carriers that perform an image formation on a recording sheet, a plurality of motors that drive the image carriers respectively to rotate, a plurality of detection units that detect an angular speed or a peripheral speed of each of the plurality of image carriers, a plurality of feedback units that perform a feedback control on the angular speeds of the plurality of motors respectively according to the result of the detection by the plurality of detection units, and a control unit that sets a feedback gain of the feedback control performed by the plurality of feedback units, wherein the control unit performs control to suppress an angular speed variation of a frequency, which causes a misalignment of images of overlaid plural colors, in a color image forming mode in which images of plural colors are overlaid by the plurality of image carriers to form a color image, and performs control to suppress an angular speed variation of a frequency, which causes a periodic uneven density on an image that is to be formed with a uniform density, in a monochrome image forming mode in which a monochrome image is formed using any one of the plurality of image carriers.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
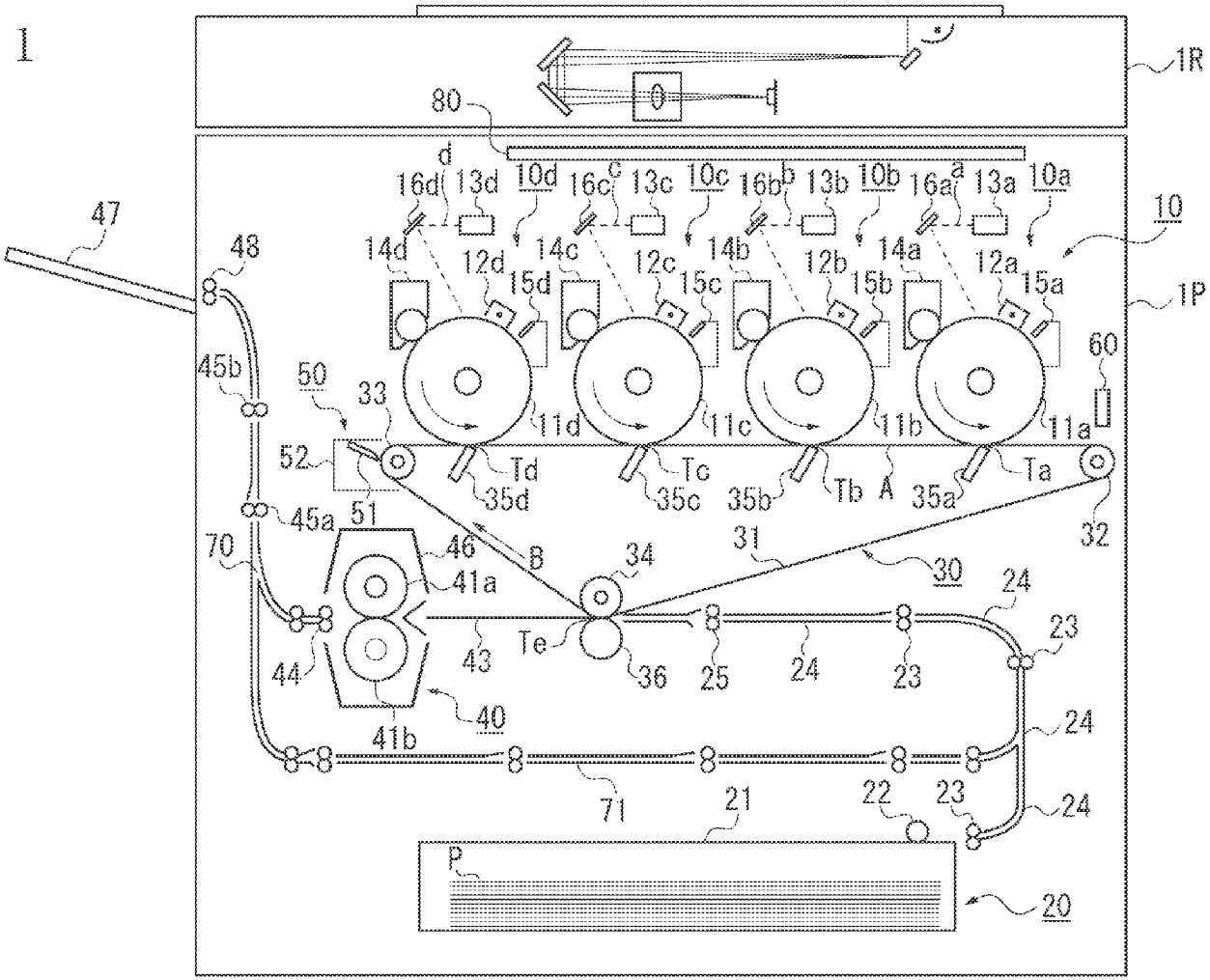
FIG. 1 is a sectional view of a color copying machine according to an exemplary embodiment of the present invention.

FIG. 1 is a sectional view of an image forming apparatus according to an exemplary embodiment of the present invention. A color copying machine according to the present exemplary embodiment includes a plurality of image forming units arranged side by side, and employs an intermediate transfer system. The color copying machine has an image reading unit 1R and an image output unit 1P.

The image reading unit 1R optically reads an image of a document, converts the read image into an electrical signal, and transmits the resultant to the image output unit 1P. The image output unit 1P includes a plurality of image forming units 10 (10*a*, 10*b*, 10*c*, 10*d*) that are provided in proximity in a row arrangement, a sheet feeding unit 20, an intermediate transfer unit 30, a fixing unit 40, and a cleaning unit 50. The respective units will be described in detail.

Each of the image forming units 10 (10*a*, 10*b*, 10*c*, 10*d*) has the same structure. A plurality of photosensitive drums 11 (11*a*, 11*b*, 11*c*, 11*d*) serving as first image carriers are rotatably supported about an axis to be rotated in a direction indicated by an arrow. Primary charging devices 12 (12*a*, 12*b*, 12*c*, 12*d*), exposure units 13 (13*a*, 13*b*, 13*c*, 13*d*), folded mirrors 16 (16*a*, 16*b*, 16*c*, 16*d*), developing devices 14 (14*a*, 14*b*, 14*c*, 14*d*), and cleaning devices 15 (15*a*, 15*b*, 15*c*, 15*d*) are arranged in the rotating direction to be opposite to the outer peripheral surfaces of the photosensitive drums 11*a* to 11*d*.

The primary charging devices 12*a* to 12*d* apply charges with a uniform charging amount onto the surfaces of the photosensitive drums 11*a* to 11*d*. The exposure units 13*a* do 13*d* expose a laser beam onto the photosensitive drums 11*a* to 11*d* via the folded mirrors 16*a* to 16*d* according to the recording image signal from the image reading unit 1R. Thus, an electrostatic latent image is formed on each of the photosensitive drums 11*a* to 11*d*.

The electrostatic latent images on the photosensitive drums 11*a* to 11*d* are made visible with the developing devices 14*a* to 14*d* that accommodate developers (hereinafter referred to as a toner) of four colors such as black, magenta, cyan, and yellow. Visible images (toner images) that are made visible on the photosensitive drums are transferred onto the intermediate transfer belt 31, serving as a second image carrier, in the intermediate transfer unit 30 at image transfer positions Ta, Tb, Tc, and Td. Although the intermediate transfer belt is employed as the second image carrier in the present exemplary embodiment, an intermediate transfer member such as an intermediate transfer drum having a drum shape may also be employed.

The cleaning devices 15*a*, 15*b*, 15*c*, and 15*d* provided at the downstream side of the image transfer positions Ta, Tb, Tc, and Td scrape off the toner, which remains on the photosensitive drums 11*a* to 11*d* without being transferred onto the intermediate transfer belt 31, to clean the surfaces of the drums. With the process described above, the image formation with the respective toners is sequentially performed.

The sheet feeding unit 20 includes a cassette 21 that stores sheets P, a pickup roller 22 that feeds the sheet P from the cassette 21 one by one, and a pair of sheet feeding rollers 23 that conveys the sheet P fed by the pickup roller 22. The sheet feeding unit 20 also includes a sheet feeding guide 24, and a registration roller 25 that feeds the sheet P to a secondary transfer position Te in synchronism with the image on the intermediate transfer belt 31.

The intermediate transfer unit 30 will be described in detail. The intermediate transfer belt 31 is held by a drive roller 32 that transmits driving force to the intermediate transfer belt 31, a driven roller 33 that is driven with the rotation of the intermediate transfer belt 31, and a secondary transfer counter roller 34. A primary transfer plane A is formed between the drive roller 32 and the driven roller 33. The drive roller 32 is rotatably driven by a motor (not illustrated).

Primary transfer charging devices 35 (35*a*, 35*b*, 35*c*, 35*d*) are arranged at the back of the intermediate transfer belt 31 at the primary transfer positions Ta to Td where the respective photosensitive drums 11*a* to 11*d* and the intermediate transfer belt 31 oppose each other. On the other hand, a secondary transfer roller 36 is arranged opposite to the secondary transfer counter roller 34 to form the secondary transfer position Te by the nip between the secondary transfer roller 36 and the intermediate transfer belt 31. The secondary transfer roller 36 is pressed against the intermediate transfer belt 31 with a proper pressure.

A cleaning unit 50 for cleaning the image forming surface of the intermediate transfer belt 31 is provided at the downstream side of the secondary transfer position Te of the intermediate transfer belt 31. The cleaning unit 50 has a cleaning blade 51 for removing the toner on the intermediate transfer belt 31, and a waste toner box 52 that accommodates a waste toner scraped off by the cleaning blade 51.

The fixing unit 40 includes a fixing roller 41*a* having a heat source such as a halogen heater incorporated therein, and a fixing roller 41*b* that is pressed against the fixing roller 41*a*. The fixing unit 40 also includes a guide 43 for guiding the sheet P to the nip portion between the fixing roller pair 41*a* and 41*b*, and a fixing heat-insulating cover 46 that traps heat of the fixing unit therein. The fixing unit 40 also includes a discharge roller 44 for guiding the sheet P, which has been discharged from the fixing roller pair 41*a* and 41*b*, to the outside of the apparatus, vertical path rollers 45*a* and 45*b*, a discharge roller 48, and a discharge tray 47 on which the sheet P is stacked.

Next, the operation of the color copying machine thus configured will be described. When an image formation start signal is transmitted from a CPU, a sheet feeding operation is started from the cassette 21. The case in which a sheet is fed from the cassette 21 will be described as an example. Firstly, the sheet P is fed one by one from the cassette 21 by the pickup roller 22. The sheet P is then guided through the sheet guide 24 by the sheet feeding roller pair 23 to be conveyed to the registration roller 25. At that time, the registration roller 25 is stopped, so that the leading end of the sheet P is brought into contact with the nip portion of the registration roller 25. Then, the registration roller 25 starts to rotate in synchronization with the image formed on the intermediate transfer belt 31. The timing of starting the rotation is set such that the sheet P and the toner image on the intermediate transfer belt 31 agree with each other at the secondary transfer position Te.

On the other hand, at the image forming unit, when the image formation start signal is issued, the toner image formed on the photosensitive drum 11*d* is primarily transferred onto the intermediate transfer belt 31 at the primary transfer position Td by the primary transfer charging device 35*d*. The primarily transferred toner image is conveyed to the following primary transfer position Tc. At the primary transfer position Tc, the image formation is performed with the delay corresponding to the time taken to convey the toner image between the respective image forming units, wherein the following toner image is positioned onto the previous image. The same process is performed at the other image forming units, whereby the toner images of four colors are primarily transferred onto the intermediate transfer belt 31. As described above, color image formation is performed on a recording sheet by the exposure units 13*a* to 13*d*, the photosensitive drums 11*a* to 11*d*, the developing devices 14*a* to 14*d*, and the intermediate transfer belt 31. When a monochrome image is formed, image formation is performed by the exposure unit 13*a*, the photosensitive drum 11*a*, the developing device 14*a*, and the intermediate transfer belt 31.

Thereafter, the sheet P enters the secondary transfer position Te, and when the sheet P is brought into contact with the intermediate transfer belt 31, a high voltage is applied to the secondary transfer roller 36 in synchronism with the timing of the passing sheet P. With this, the toner image of four colors formed on the intermediate transfer belt 31 by the above-mentioned process is transferred onto the sheet P. Then, the sheet P is guided to the nip portion of the fixing rollers 41*a* and 41*b* by the guide 43. The toner image is fixed onto the sheet P with the heat of the fixing roller pair 41*a* and 41*b* and pressure at the nip. Thereafter, the sheet P is conveyed by the discharge roller 44, the vertical path rollers 45*a* and 45*b*, and the discharge roller 48, to be discharged to the outside of the apparatus, and stacked onto the discharge tray 47.

Figure 2:
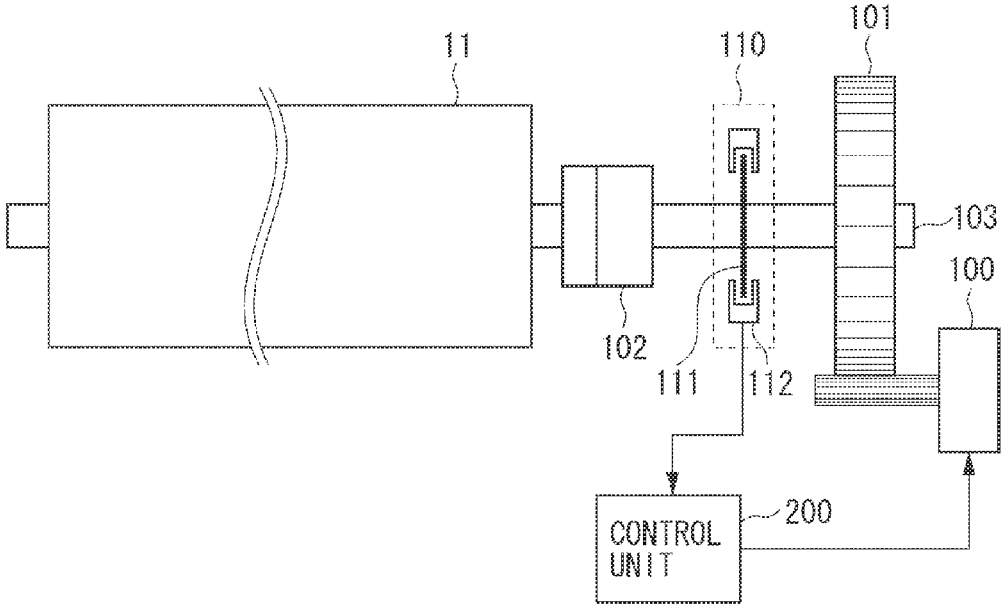
FIG. 2 is a diagram describing a drive configuration of a photosensitive drum.

Next, the drive of the photosensitive drums 11 by a motor control apparatus included in the image forming apparatus will be described with reference to FIG. 2. In the present exemplary embodiment, a direct-current (DC) brushless motor 100 is provided to each of the photosensitive drums 11*a* to 11*d*. The motor 100 is controlled by a control unit 200. The driving force of the motor 100 is transmitted to the corresponding photosensitive drum 11 via a gear 101, a drive shaft 103, and a coupling 102. Thus, the photosensitive drum 11 is rotated.

An encoder wheel 111 is fixed to the drive shaft 103, wherein the drive shaft 103 and the encoder wheel 111 rotate with the same angular speed. The encoder 110 has the encoder wheel 111 and an encoder sensor 112. The encoder wheel 111 is a transparent disk having black lines printed radially thereon as being equally spaced along a circumference. The encoder sensor 112 has a light-emitting portion and a light-receiving portion that are provided across the encoder wheel 111. When the black portion of the disk is located at the position of the light-receiving portion, the light to the light-receiving portion is shielded, while when the transparent portion of the disk is located at the position of the light-receiving portion, the light is incident on the light-receiving portion. The encoder sensor 112 generates a signal depending on whether light is incident on the light-receiving portion. As described above, the encoder 110 supplies a signal having a period according to the angular speed of the drive shaft 103, to the control unit 200. The control 200 performs a feedback control of the motor 100 based on the signal from the encoder 110.

Figure 3:
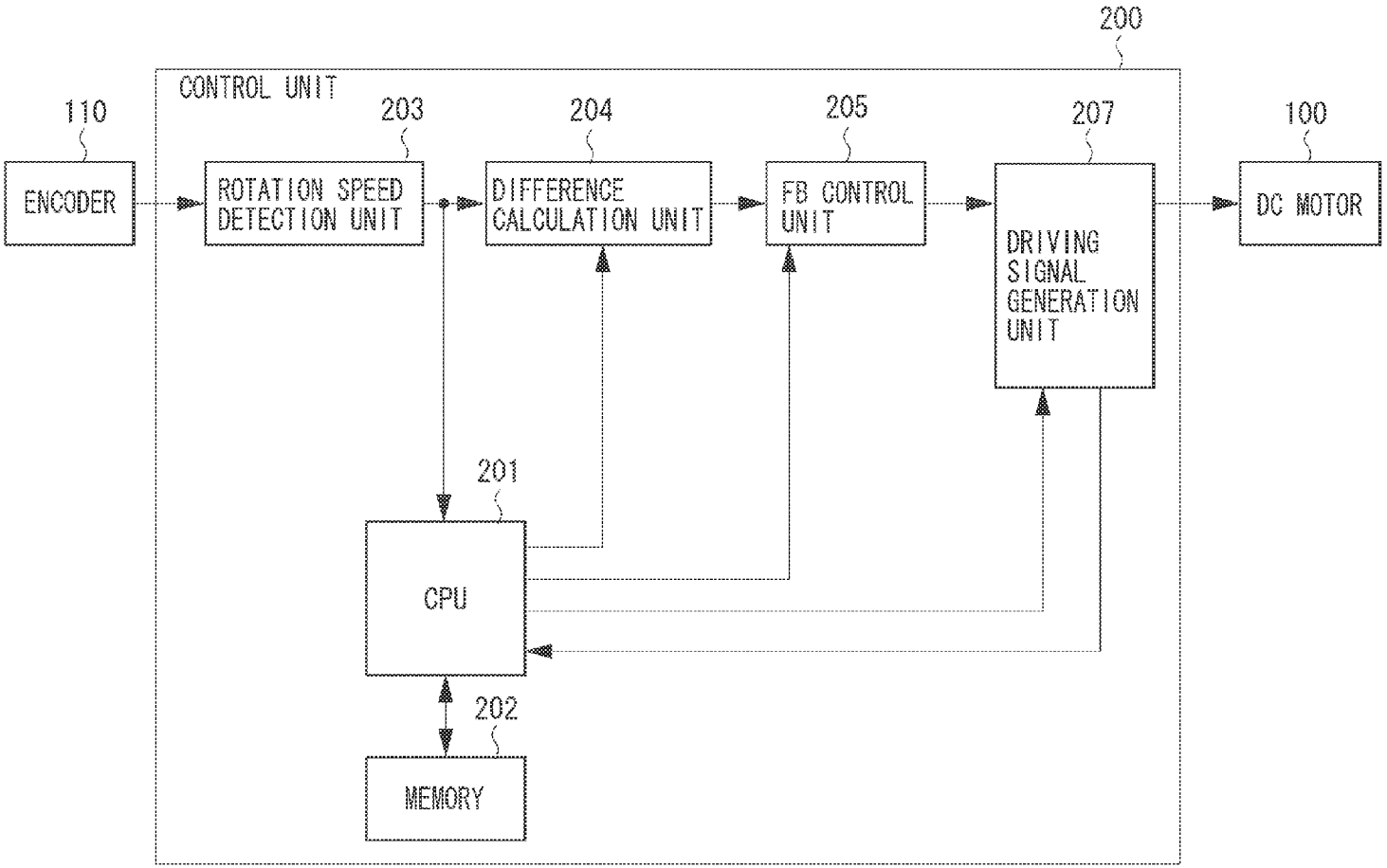
FIG. 3 is a block diagram of a control unit that controls a motor.
Figure 4:
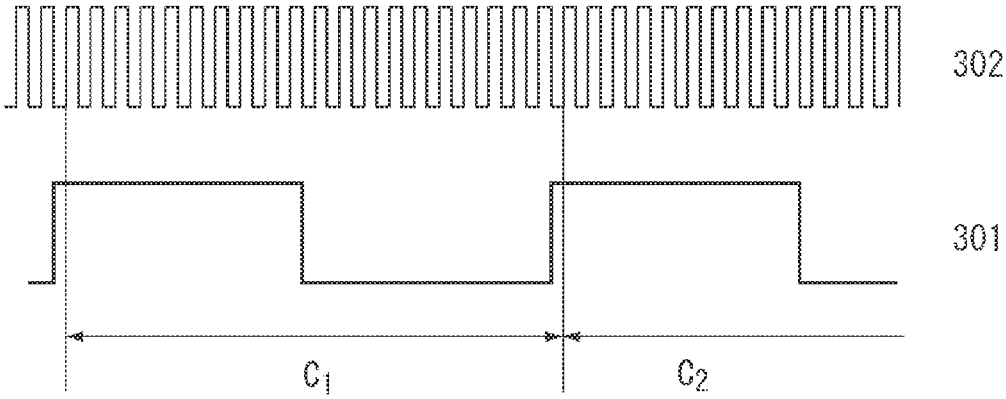
FIG. 4 is a diagram describing a detection by a rotation speed detection unit.

FIG. 3 is a block diagram illustrating a configuration of the control unit 200. A rotation speed detection unit 203 detects the cycle of the pulse signal from the encoder 110. The rotation speed detection unit 203 detects the cycle of the pulse signal 301 by counting the number of clocks 302 in one cycle ($C_1$: from the rise of the pulse signal 302 to the following rise) of the pulse signal 301 illustrated in FIG. 4. The clock 302 is a pulse signal that has a fixed cycle shorter than the cycle of the pulse signal 301. The clock 302 is generated by a crystal oscillator, and input into the rotation speed detection unit 203.

Figure 5A:
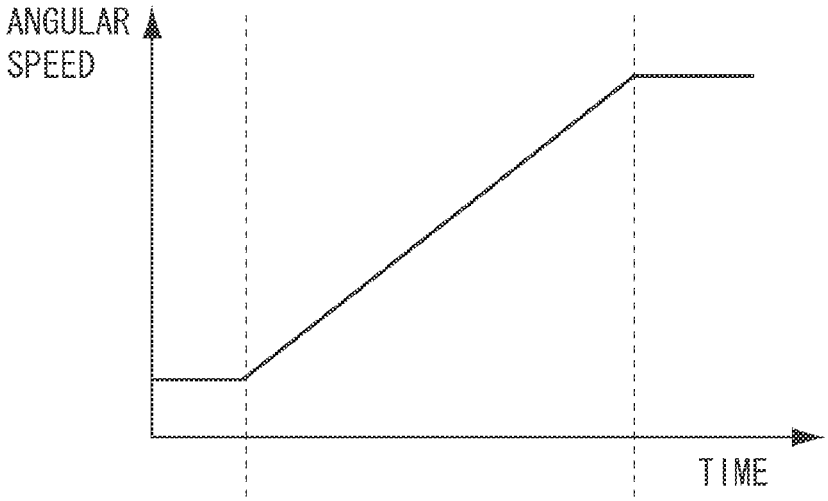
FIGS. 5A and 5B are diagrams illustrating a relationship between a count and an angular speed at the rotation speed detection unit.
Figure 5B:
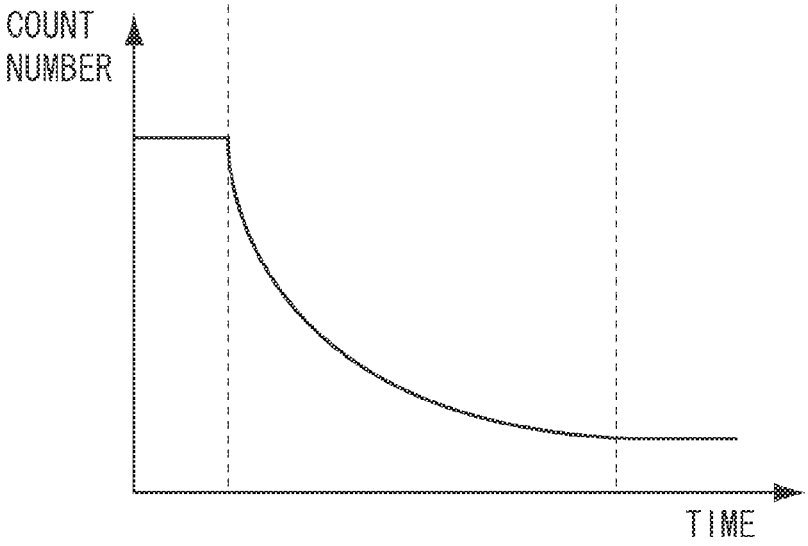

The rotation speed detection unit 203 then calculates the angular speed from the detected pulse width. FIG. 5A illustrates the change in the angular speed of the drive shaft 103 when the motor 100 is started, while FIG. 5B illustrates the count number (pulse cycle) counted at the rotation speed detection unit 203 at that time. As understood from the figure, the angular speed and the count number are in an inverse relationship. Accordingly, the angular speed is calculated based on the formula 1. The rotation speed detection unit 203 outputs the detected angular speed to a difference calculation unit 204 and the CPU 201. K is an optional coefficient.

$$\text{Angular speed} = K/(\text{Count number}) \qquad \text{(Formula 1)}$$

The difference calculation unit 204 calculates the difference between the detected angular speed output from the rotation speed detection unit 203 and the target angular speed supplied from the CPU 201. A FB control unit 205 calculates a corrected control value required for the drive shaft 103 to rotate with the target angular speed based on the difference value output from the difference calculation unit 204 and a feedback gain value ($K_p$, $T_I$, $T_D$) supplied from the CPU 201.

A driving signal generation unit 207 generates a pulse-width-modulation (PWM) control signal of a duty based on a control value, which is obtained by adding the corrected control value output from the FB control unit 205 and the target control value output from the CPU 201. The PWM control signal is a signal for subjecting the motor 100 to the PWM control (pulse width modulating control).

Figure 6:
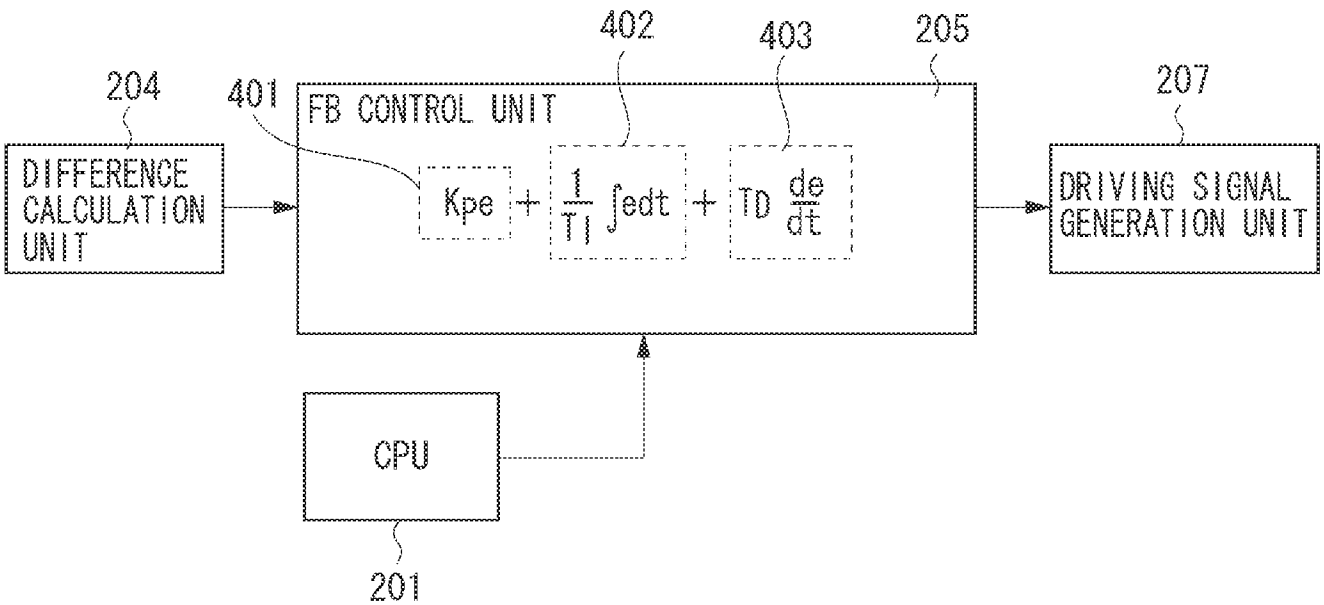
FIG. 6 is a diagram describing a process at a feedback (FB) control unit.

FIG. 6 is a diagram illustrating a process at the FB control unit 205. The FB control unit 205 performs a proportional integral derivative (PID) control based on a difference value e output from the difference calculation unit 204. The control value of the PID control is calculated based on the formula 2.

$$K_p e + \frac{1}{T_1}\int e\,dt + T_D\frac{de}{dt} \qquad \text{(Formula 2)}$$

Here, $K_p$, $T_I$, $T_D$ are feedback gain values in a proportional term 401, integral term 402, and derivative term 403 in the PID control. They are determined by the CPU 201 based on the angular speed of the drive shaft 103.

Figure 7:
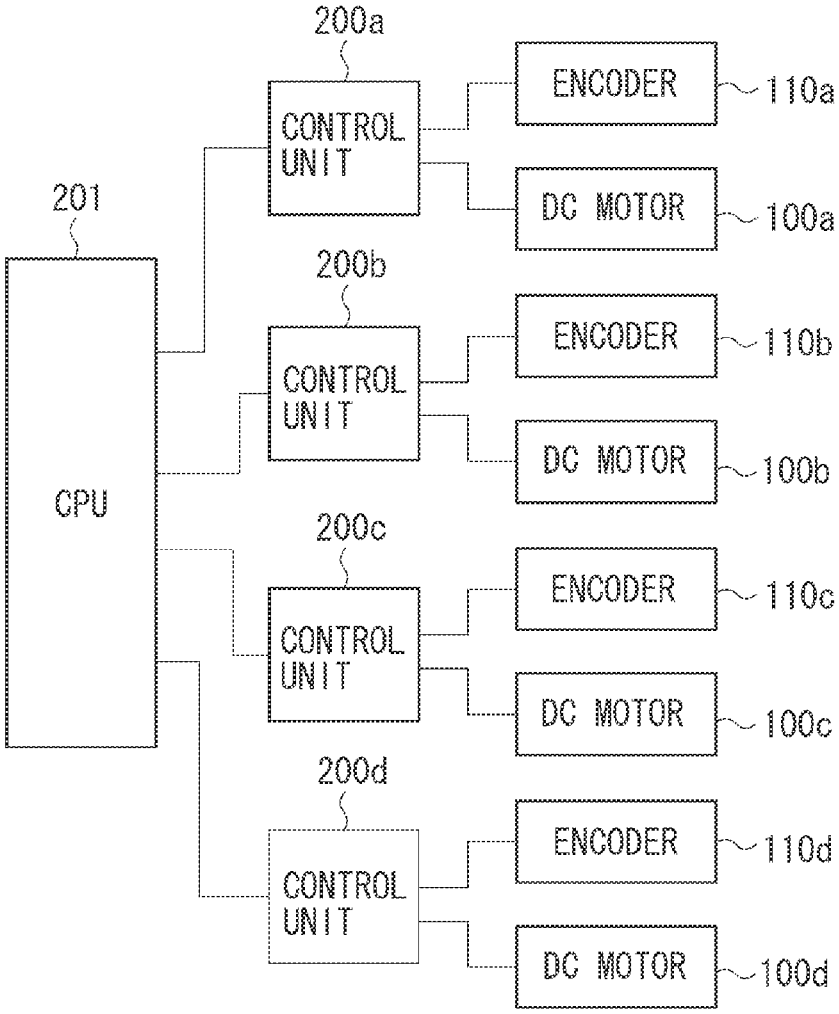
FIG. 7 is a control block diagram of a motor that drives photosensitive drums 11*a* to 11*d*.

FIG. 7 is a control block diagram of DC brushless motors 100*a* to 100*d* for driving the photosensitive drums 11*a* to 11*d*. The respective photosensitive drums 11*a* to 11*d* are provided with the corresponding encoders 110*a* to 110*d* and motors 100*a* to 100*d*, wherein the motors 100*a* to 100*d* are controlled by the corresponding control units 200*a* to 200*d*. The control units 200*a* to 200*d* perform the feedback control of the motors 100*a* to 100*d* based on the signal from the encoders 110*a* to 110*d*. The configurations of the control units 200*a* to 200*d* are the same as that of the control unit 200. The CPU 201 sets the target angular speed, the feedback gain value, and the target control value to the control units 200*a* to 200*d* as described above. Specifically, the apparatus is provided with a first and a second image carriers for performing an image formation on a recording sheet, a first and a second motors for rotatably driving the respective first and the second image carriers, and a first and a second detection units (encoders) that detect an angular speed or a peripheral speed (or circumferential speed) of the first and the second image carriers respectively. The apparatus further includes a first and a second feedback units (control unit 200) that respectively perform a feedback control on the angular speed of the first and the second motors according to the result of the detection by the first and the second detection units, and a control unit (CPU 201) that sets a feedback gain for the feedback control of the first and the second feedback units.

Figure 8A:
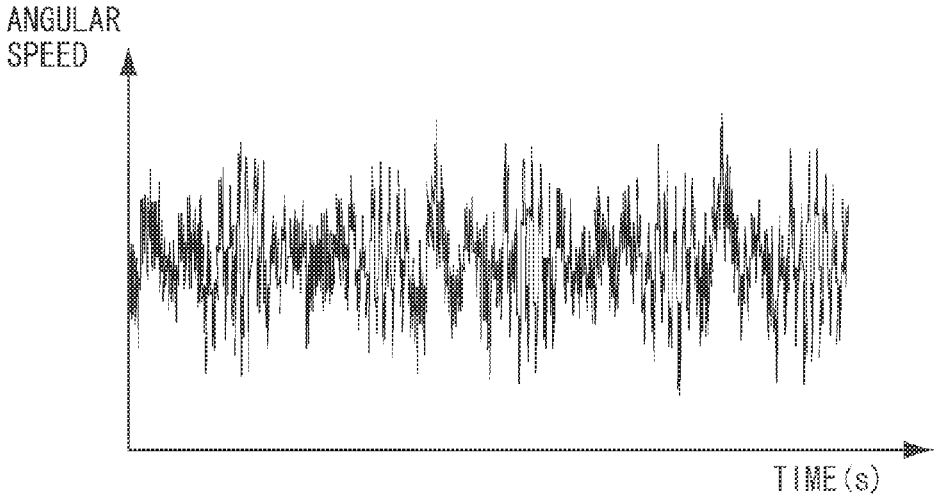
FIGS. 8A and 8B are graphs illustrating a temporal change of an angular speed of the photosensitive drum and a frequency component of the angular speed variation.
Figure 8B:
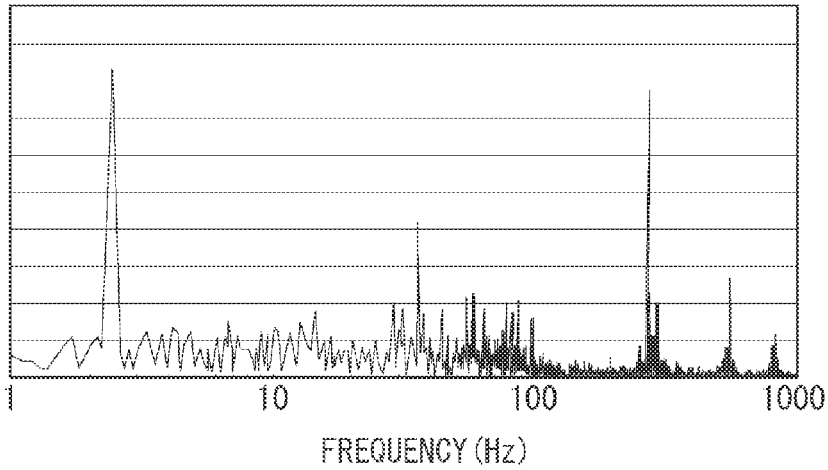

FIG. 8A is a graph illustrating a temporal change in the angular speed of the photosensitive drum 11 driven by the motor 100 via the gear 101. FIG. 8B is a graph in which a variation component of the angular speed, which is obtained by performing Fourier transformation on the angular speed change, for each frequency. In FIG. 8B, peaks appear at about 3 Hz, about 36 Hz, and about 290 Hz. The variation in the relatively low frequency component at and near 3 Hz is an eccentric component of a gear 101, the variation at and near 36 Hz is an uneven rotation of a motor 100, and the variation at and near 290 Hz is a vibration generated when the gear 101 and the motor 100 mesh with each other. The variation in the angular speed at and near 3 Hz causes a color misregistration in which toner images of plural colors, which are to be overlaid with each other, are not overlaid with each other during the color image formation, and the variation in the angular speed at and near 36 Hz causes a banding (uneven pitch) in which an image, which is to be formed with a uniform density, has a periodic uneven density. The banding tends to be noticeable when a monochrome image is formed, in particular.

Figure 9A:
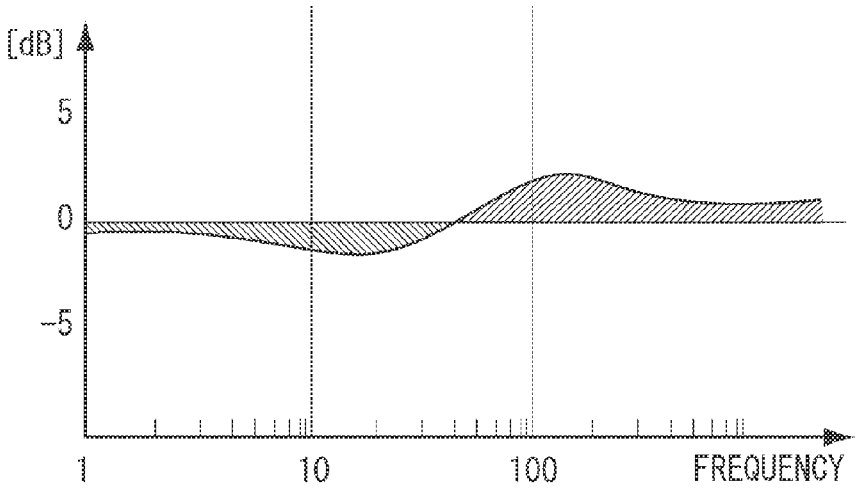
FIGS. 9A and 9B are views describing a sensitivity function vis-a-vis a feedback gain.
Figure 9B:
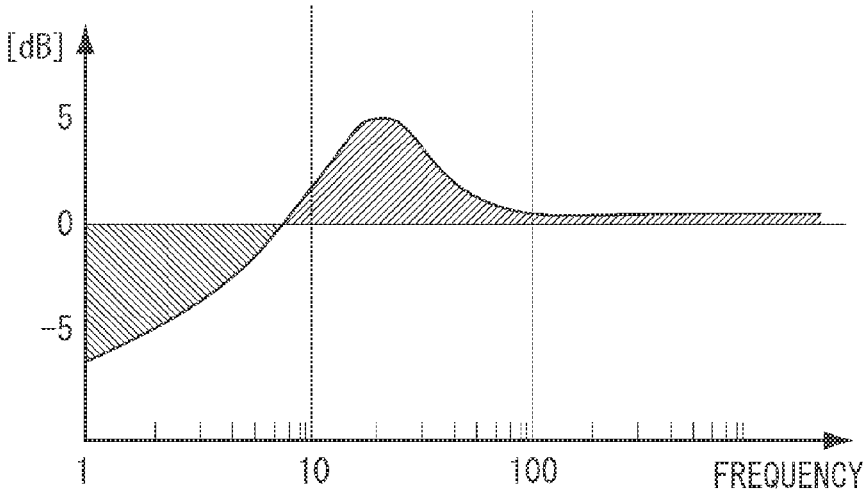

The angular speed variation illustrated in FIG. 8B can be suppressed by adjusting a feedback gain value, but the angular speed variation of all frequencies cannot be suppressed. According to a sensitivity function in the feedback control, when a variation of a certain frequency is to be attenuated, a variation of another frequency is amplified. FIG. 9 is a graph describing the sensitivity function, wherein FIGS. 9A and 9B illustrate the sensitivity function when a different feedback gain is set. In FIG. 9, the angular speed variation is amplified for the frequency indicating a response greater than 0 dB, while the angular speed variation is attenuated for the frequency indicating a response smaller than 0 dB. 0 dB means that the angular speed variation is neither amplified nor attenuated. In the sensitivity function illustrated in FIG. 9A, force for correcting the angular speed variation is weak as a whole, wherein the angular speed variation at and near 20 Hz is attenuated most, while the angular speed at the frequency of 40 Hz or more is amplified. In the sensitivity function illustrated in FIG. 9B, the force for correcting the angular speed variation is strong as a whole for the frequency of 100 Hz or less, wherein the angular speed variation of the frequency not more than 8 Hz is attenuated, while the angular speed variation of the frequency about 20 Hz is amplified. This sensitivity function is represented by the formula 3. When a variation of a certain frequency is intended to be attenuated, a variation of another frequency is amplified. Therefore, this is called a waterbed effect.

$$\int_0^\infty \log|S(j\omega)|\,d\omega = 0 \qquad \text{(Formula 3)}$$

Figure 10A:
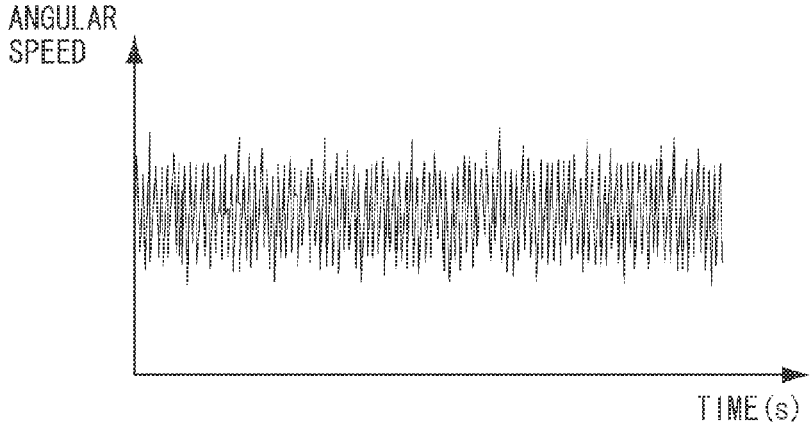
FIGS. 10A, 10B, and 10C are graphs respectively illustrating a temporal change of an angular speed, a frequency component of the angular speed variation, and a sensitivity function, when a feedback gain for suppressing a color misregistration is set.
Figure 10B:
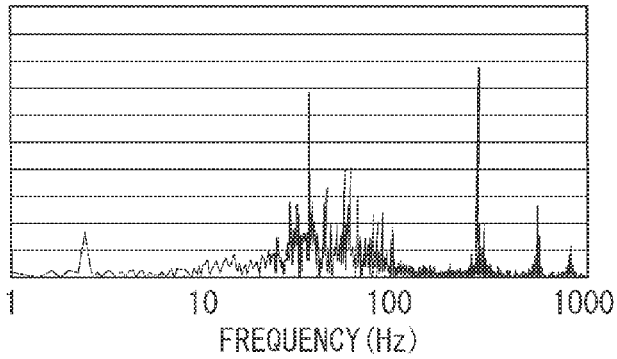
Figure 10C:
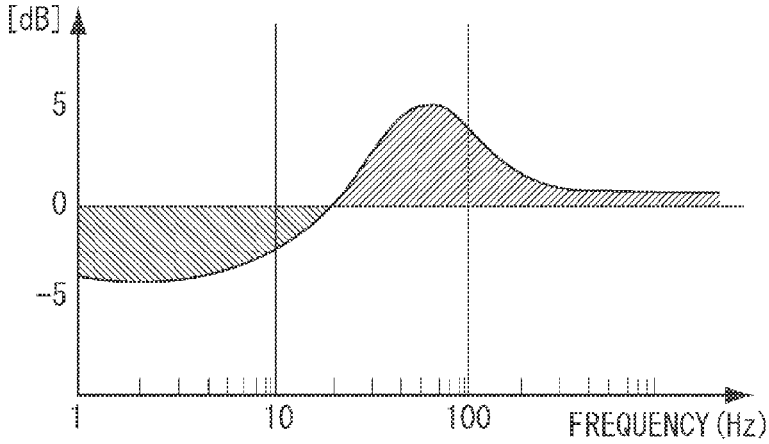

FIG. 10 is a graph (FIG. 10A) illustrating a temporal change in the angular speed, a graph (FIG. 10B) illustrating a frequency component of the angular speed variation, and a graph (FIG. 10C) illustrating the sensitivity function, when the feedback gain for suppressing the angular speed variation at or near 3 Hz is set. As illustrated in the sensitivity function in FIG. 10C, the angular speed variation at and near 3 Hz is greatly suppressed, but the angular speed variation at and near 50 Hz is greatly amplified. As can be understood from the comparison between FIGS. 10B and 8B, the angular speed variation at and near 3 Hz, which causes the color misregistration, can be suppressed, while the angular speed variation at and near 36 Hz, which causes the banding, is amplified. In the present exemplary embodiment, the feedback gain having the sensitivity function described above is set during the color image formation. With this, the color misregistration, which is a problem during the color image formation, can be prevented. On the other hand, the banding is emphasized. It is during the monochrome image formation that the banding is noticeable.

During the color image formation, the suppression of the color misregistration takes priority, so that the feedback gain for suppressing the color misregistration is set during the color image formation. Specifically, in a first image forming mode in which images formed on the first and the second image carriers are overlaid, a first feedback gain for suppressing the angular speed variation of a first frequency, which causes a misalignment of the images to be overlaid, to the first and the second feedback units (control unit 200). In other words, in a multi-color image forming mode in which a multi-color image is formed by overlaying images of plural colors on the plurality of image carriers, it is controlled such that the angular speed variation of the first frequency, which causes the misalignment of the images of overlaid plural colors, is suppressed.

Figure 11A:
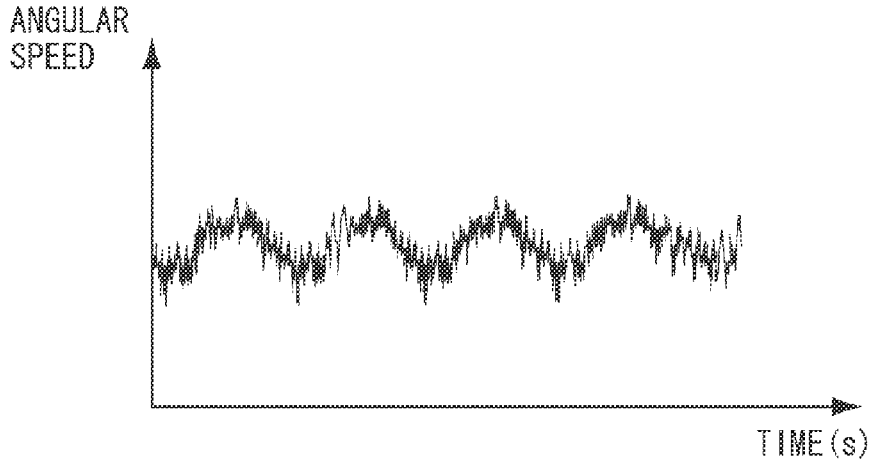
FIGS. 11A, 11B, and 11C are graphs respectively illustrating a temporal change of an angular speed, a frequency component of the angular speed variation, and a sensitivity function, when a feedback gain for suppressing a banding is set.
Figure 11B:
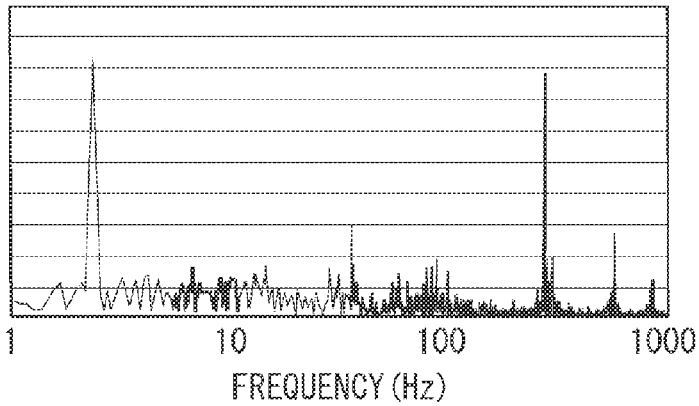
Figure 11C:
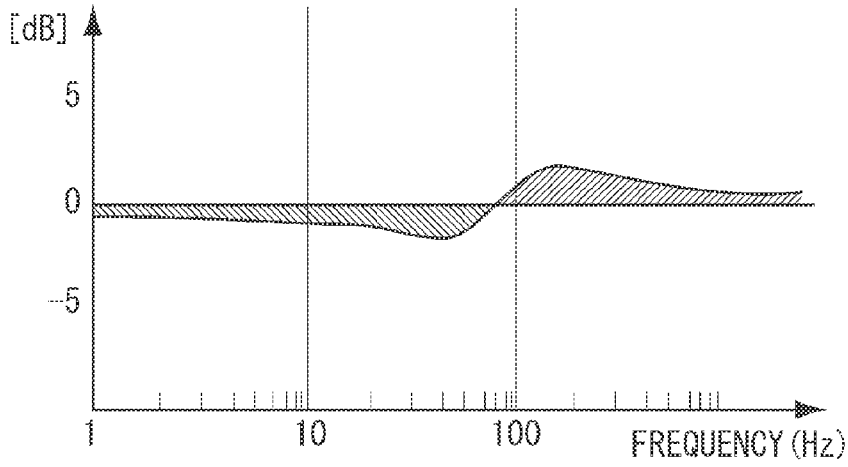

FIG. 11 is a graph (FIG. 11A) illustrating a temporal change in the angular speed, a graph (FIG. 11B) illustrating a frequency component of the angular speed variation, and a graph (FIG. 11C) illustrating the sensitivity function, when the feedback gain for suppressing the angular speed variation at or near 40 Hz is set. As illustrated in the sensitivity function in FIG. 11C, the angular speed variation at and near 40 Hz is greatly suppressed, but the angular speed variation at and near 200 Hz is greatly amplified. As can be understood from the comparison between FIGS. 11B and 8B, the angular speed variation at and near 36 Hz, which causes the banding, can be suppressed, while the angular speed variation at and near 3 Hz, which causes the color misregistration, is not suppressed. In the present exemplary embodiment, the feedback gain having the sensitivity function described above is set during the monochrome image formation. With this, the banding, which is a problem during the monochrome image formation, can be prevented. On the other hand, the color misregistration cannot be prevented, as a result.

During the monochrome image formation, there is no chance that toner images of plural colors are overlaid, so that it is unnecessary to care about the angular speed variation, which causes the color misregistration. Therefore, during the monochrome image formation, the feedback gain for suppressing the banding is set. This feedback gain is set to at least the control unit 200*a* corresponding to the photosensitive drum 11*a* for a black color. Specifically, when a second image forming mode in which an image is formed using either one of the first and the second image carriers, a second feedback gain for suppressing the angular speed variation of a second frequency that causes a periodic uneven density on the image having a uniform density is set to at least one of the first and the second feedback units (control unit 200) corresponding to the image carrier that performs the image formation. In other words, in a monochrome image forming mode in which a monochrome image or a single color image is formed using any one of a plurality of image carriers, it is controlled such that the angular speed variation of the second frequency that causes a periodic uneven density on the image having a uniform density is suppressed.

Figure 12:
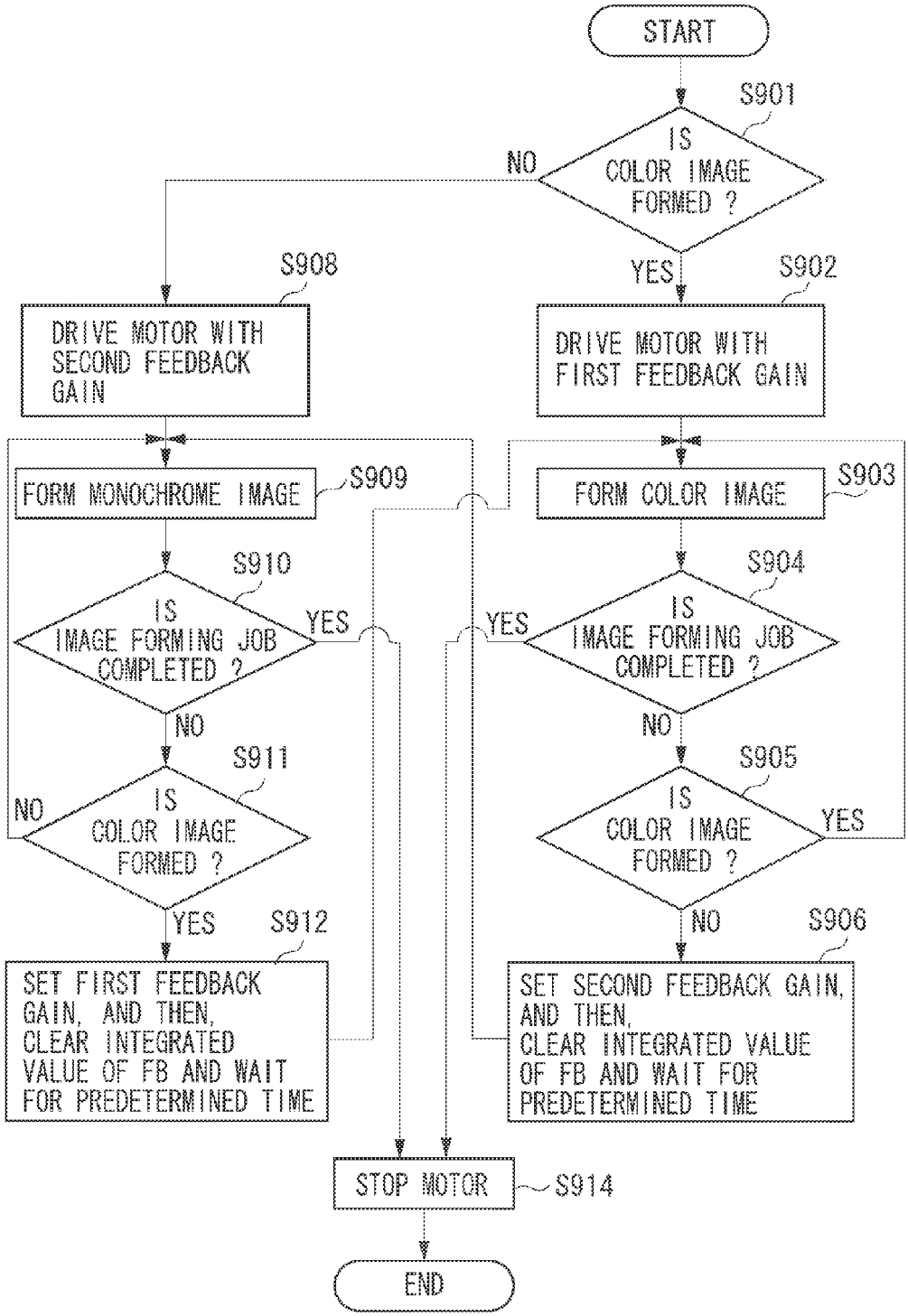
FIG. 12 is a control flowchart of a control processing unit (CPU) that controls a feedback gain.

FIG. 12 is a control flowchart of the CPU 201 that performs control to change the feedback gain in the motor control for driving the photosensitive drum, depending on whether the mode is the color image forming mode or the monochrome image forming mode. When an image forming job is started, the CPU 201 determines whether the mode is the color image forming mode based on the setting on the operation unit or the automatic color determination for a document in step S901. When the CPU 201 determines that the mode is the color image forming job (YES in step S901), the CPU 201 sets the first feedback gain to the control units 200*a* to 200*d* to drive the motors 100*a* to 100*d* in step S902. The first feedback gain suppresses the angular speed variation at and near 3 Hz, which causes the color misregistration. In step S903, the CPU 201 allows the image forming apparatus to perform the color image formation, and in step S904, the CPU 201 determines whether the image forming job is completed.

When the image forming job is not completed (No in step S904), the CPU 201 determines whether the following image is formed in the color image forming mode in step S905. When it is determined that the following image is formed in the color image forming mode (YES in step S905), the processing returns to step S903. On the other hand, when it is determined that the following image is formed in the monochrome image forming mode in step S906 (NO in step S905), the CPU 201 sets the later-described second feedback gain to the control units 200*a* to 200*d*, and then, the value integrated in the FB control unit 205 is cleared in step S906. When the feedback gain is changed, the rotation of the motor might be unstable during several ten milliseconds to several hundred milliseconds. Therefore, the processing proceeds to step S909 when a predetermined time has elapsed after the feedback gain is changed in step S906. The predetermined time is the time for making the motor control stable, and it is about 150 ms, for example.

When it is determined in step S901 that the mode is the monochrome image forming mode (NO in step S901), the CPU 201 sets the second feedback gain to the control units 200*a* to 200*d* to drive the motors 100*a* to 100*d* in step S908. The second feedback gain is the one for suppressing the angular speed variation at and near 40 Hz, that is, the second feedback gain suppresses the angular speed variation at and near 36 Hz, which causes the banding. Then, in step S909, the CPU 201 allows the image forming apparatus to perform the monochrome image formation, and in step S910, it determines whether the image forming job is completed. When the image forming job is not completed (NO in step 910), the CPU 201 determines whether the following image is formed in the color image forming mode in step S911. When it is determined that the following image is formed in the monochrome image forming mode (NO in step S911), the processing returns to step S909.

On the other hand, if it is determined in step S911 that the following image is formed in the color image forming mode (YES in step S911), the CPU 201 sets the first feedback gain to the control units 200*a* to 200*d*, and then, clears the value integrated in the FB control unit 205 in step S912. When a predetermined time has elapsed after the feedback gain is changed in step S912, the processing proceeds to step S903. When it is determined in step S904 or S910 that the image forming job is completed (YES in step S904 or S910), the CPU 201 stops the motors 100*d* to 100*d* in step S914 to end the image forming job.

As described above, the feedback gain is changed depending on whether the mode is the color image forming mode, whereby a high-quality image in which a color misregistration is suppressed can be formed in the color image forming mode, while a high-quality image in which a banding is suppressed can be formed in the monochrome image forming mode.

When an image of "Confidential" or a copy-forgery-inhibited pattern image is overlaid on a background with a clear toner during the monochrome image forming mode, the control for the monochrome image forming mode is employed in the present exemplary embodiment.

In the present exemplary embodiment, the feedback gain that is advantageous for the color misregistration is set during the color image forming mode. However, when a photographic image having unclear edge of an image and an image area with a uniform density is formed in the color image forming mode, the feedback gain that is advantageous for the banding may be set. This is because, in the photographic image described above, the banding is likely to be more noticeable than the color misregistration. Specifically, when a photographic image or an image having an image area of a uniform density is formed in the first image forming mode in which the images on the first and the second image carriers are overlaid, the first feedback gain for suppressing the angular speed variation of the second frequency, which causes the periodic uneven density on the image having the uniform density, is set to the first and the second feedback units (control unit 200). On the other hand, when an image, which is not the photographic image, and which does not have an image area of a uniform density, is formed in the first image forming mode, the first feedback gain for suppressing the angular speed variation of the first frequency, which causes the misalignment of the overlaid images, is set to the first and the second feedback units (control unit 200).

In the present exemplary embodiment, the plurality of photosensitive drums is driven by the plurality of motors. However, the same control can be executed even in the configuration in which some of the photosensitive drums are driven by a first motor, and the remaining photosensitive drums are driven by a second motor.

The feedback gain for the motor control for driving the photosensitive drums is described in the present exemplary embodiment. However, the same is true with the feedback gain for the motor control for driving the intermediate transfer belt.

In the present exemplary embodiment, the feedback gain of the FB circuit is dealt with. However, when a filter such as a low-pass filter is arranged before the FB input unit, a constant of the filter may also be changed. Specifically, during the color image forming mode, a first filter constant for suppressing the color misregistration may be set, while a second filter constant for suppressing the banding may be set during the monochrome image forming mode.

In the present exemplary embodiment, the angular speed of the motor 100 is detected by the encoder 110 attached to the drive shaft 103. However, the angular speed may be detected based on a FG signal from the motor 100. Alternatively, the peripheral speed of the photosensitive drum 11 or the intermediate transfer belt 31 may be detected, and the feedback control may be executed according to the result of the detection.

In the present exemplary embodiment, the values of the control units 200*a* to 200*d* are changed while all photosensitive drums 11*a* to 11*d* are driven. However, the present invention is applicable to an image forming apparatus having a mechanism for separating the intermediate transfer belt 31 from the photosensitive drums 11*b* to 11*d* during the monochrome image forming mode.

The color image is formed by the plurality of photosensitive drums in the present exemplary embodiment. However, the present invention is also applicable to a configuration in which a color image is formed by a single photosensitive drum and a plurality of developing devices.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An image forming apparatus comprising:

first and second image carriers on which first and second images are formed;

first and second motors that rotate the first and second image carriers respectively;

first and second detection units that detect an angular speed or a peripheral speed of each of the first and second image carriers respectively;

first and second feedback units that perform a feedback control on the first and second motors respectively according to detection results of the first and the second detection units; and a control unit that determines an image forming mode, and sets a feedback gain of the feedback control performed by the first and second feedback units based on the determined image forming mode, wherein the control unit sets a first feedback gain for suppressing an angular speed variation of a first frequency in a first image forming mode, and sets a second feedback gain for suppressing an angular speed variation of a second frequency in a second image forming mode, the second frequency being different from the first frequency.

2. The image forming apparatus according to claim 1, wherein, in the first image forming mode, the first and second images are overlaid, and a multi-color image is formed, in the second image forming mode, a single-color image is formed, the first frequency causes a misalignment of the first and second images to be overlaid, and the second frequency causes a periodic uneven density on a first image to be formed with a uniform density, and wherein the control unit sets the first feedback gain to the first and second feedback units in the first image forming mode, and sets the second feedback gain to the first feedback gain in the second image forming mode.

3. The image forming apparatus according to claim 2, wherein the single color image forming mode is a monochrome image forming mode.

4. The image forming apparatus according to claim 1, wherein the control unit sets a feedback gain different from the first feedback gain in a case where a photographic image is formed.

5. The image forming apparatus according to claim 1, wherein the first and second image carriers are photosensitive drums for forming a toner image.

6. The image forming apparatus according to claim 5, wherein, when the image forming mode is the multi-color image forming mode and the image type is not the photographic image, the control unit sets the first feedback gain to the first and second feedback unit.

7. The image forming apparatus according to claim 1, wherein the second image forming mode is a monochrome image forming mode.

8. The image forming apparatus according to claim 1, wherein the first feedback gain is the one for suppressing the angular speed variation at 3 Hz, and the second feedback gain is the one for suppressing the angular speed variation at 36 Hz.

9. The image forming apparatus according to claim 1, wherein the control unit sets the feedback gain based on the determined image forming mode and image type, and wherein, when the image forming mode is the multi-color image forming mode and the image type is a photographic image, the control unit sets the second feedback gain to the first and second feedback means.

10. The image forming apparatus according to claim 1, wherein the control unit sets the feedback gain of the feedback control performed by the first and second feedback unit based on the determined image forming mode and image type, and wherein, when the image forming mode is the multi-color image forming mode and the image type is an image having an image area of a uniform density, the control unit sets the second feedback gain to the first and second feedback units.

* * * * *